US005308057A

United States Patent [19]

Thoma

[11] Patent Number: 5,308,057

[45] Date of Patent: May 3, 1994

[54] FEED TABLE OF A SHEET-FED PRINTING PRESS

[75] Inventor: Peter Thoma, Mannheim, Fed. Rep. of Germany

[73] Assignee: Heidelberger Druckmaschinen AG, Heidelberg, Fed. Rep. of Germany

[21] Appl. No.: 911,463

[22] Filed: Jul. 10, 1992

[30] Foreign Application Priority Data

Jul. 10, 1991 [DE] Fed. Rep. of Germany ..... 4122770

[51] Int. Cl.[5] ..... B65H 9/16

[52] U.S. Cl. ..... 271/248; 271/253; 271/264

[58] Field of Search ..... 271/171, 248, 253, 223, 271/302, 305, 264; 108/20, 84, 319.8; 312/223.2, 223.8; 211/149

[56] References Cited

U.S. PATENT DOCUMENTS 2,801,849 8/1957 Backhouse .
4,003,462 1/1977 Perrott ..... 271/302 X
4,424,966 1/1984 Chandhoke ..... 271/302
4,469,323 9/1984 Miyashita et al. ..... 271/302 X
5,022,638 6/1991 Ifkovits, Jr. ..... 271/305 X
5,104,117 4/1992 McCormick et al. ..... 271/305

FOREIGN PATENT DOCUMENTS 268693 6/1988 European Pat. Off. .
1031811 6/1958 Fed. Rep. of Germany .
0052142 3/1983 Japan ..... 271/223
0239041 9/1990 Japan ..... 271/171

*Primary Examiner*—H. Grant Skaggs
*Attorney, Agent, or Firm*—Herbert L. Lerner; Laurence A. Greenberg

[57] ABSTRACT

A method of forming and varying size and/or location of pass-through openings in a table top of a feed table of a sheet-fed printing press includes providing a plurality of adjustable table-top elements, and varying the position of the table-top elements with respect to the table top of the feed table; and a feed having a device for performing the method.

9 Claims, 5 Drawing Sheets 15
17
16
12
1
3
2
18
5
11
18
5
11
18
9a
8
9
18
5
7
11
III
III
10
9b
18
9a
6
4
2a
27
25
26
30
2b
5

FEED TABLE OF A SHEET-FED PRINTING PRESS

The invention relates to a method of forming and varying size and/or location of pass-through openings in a table top of a feed table of a sheet-fed printing press, and to a feed table having means for performing the method.

From German Patent 10 31 811, it has become known heretofore to lift individual table-top elements manually out of the table top of a feed table and to remove them, in order to vary the position of a side lay extending through the table top with respect to the table top. The table-top elements must be stored outside of the printing press. The adjustment of the side lay requires considerable manual effort and time on the part of the operator for making sufficient space ready for the new position of the side lay in the table top. Complete removal of the table-top elements from and assembly thereof in the printing press manually increases the danger of damage to the table-top elements or the table top itself, which can have a negative effect upon sheet travel or transport.

It is accordingly an object of the invention to provide a feed table and a method of forming and varying size and/or location of pass-through openings in the table top of the feed table which minimizes the time and manual effort required for changing the position of the side lay and otherwise avoids the disadvantages of heretofore known methods and feed tables of these general types.

With the foregoing and other objects in view, there is provided, in accordance with a first aspect of the invention, a method of forming and varying size and/or location of pass-through openings in a table top of a feed table of a sheet-fed printing press, which comprises providing a plurality of adjustable table-top elements, and varying the position of the table-top elements with respect to the table top of the feed table.

In accordance with another mode of the invention, the method includes moving the table-top elements from a first position thereof wherein they are in a common plane with the table top to a second position thereof wherein they extend below the table top.

In accordance with a further mode of the invention, the method includes simultaneously moving a plurality of the table-top elements out of the first position thereof into the second position thereof; returning at least one of the table-top elements to the first position thereof while retaining at least one of the table-top elements in the second position thereof.

In accordance with another aspect of the invention, there is provided a feed table of a sheet-fed printing press, comprising a table top formed with pass-through openings therein extending transversely to a travel direction in which sheets are fed along the table, a plurality of juxtaposed adjustable table-top elements, in a first position thereof, closing the pass-through openings, and actuating means for moving the table-top elements out of the first position thereof and into a second position thereof wherein the pass-through openings are open.

In accordance with an added feature of the invention, the table-top elements, in the first position thereof, are in a common plane with the table top and, in the second position thereof, are disposed below the table top.

In accordance with an additional feature of the invention, the actuating means comprise an actuating member common to the plurality of table-top elements, and respective energy-storage mechanisms are included for resiliently connecting each of the table-top elements to the actuating member.

In accordance with yet another feature of the invention, the second position of the table-top elements below the table to is a swivel position with respect to the first position thereof.

In accordance with yet a further feature of the invention, the actuating member is a driven actuating shaft.

In accordance with a concomitant feature of the invention, the actuating shaft is disposed below the table top and extends transversely to the travel direction of the sheets, each of the table-top elements is fastened at a respective edge portion thereof axially to the actuating shaft, the energy-storage mechanisms comprise respective torsion springs braced against a spring bearing on the table top for applying spring force from below to the table-top elements, and a pneumatic cylinder is drivingly connected to the actuating shaft.

Due to the installation of just one common actuating member for the table-top elements, the table-top elements can be removed together from the first position thereof in the table top so that, initially, a pass-through opening accommodating all of the table-top elements is created within which the devices to extend through the table top and requiring adjustment into the position thereof can be so adjusted within the entire pass-through opening. The energy storage mechanism permits the table-top elements to be returned to the first position thereof in the table top by using a common actuation member, so that one or more of the pass-through openings are retained for accommodating therein devices which extend through the table top after those devices have been suitably adjusted.

Other features which are considered as characteristic for the invention are set forth in the appended claims.

Although the invention is illustrated and described herein as embodied in a feed table of a sheet-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
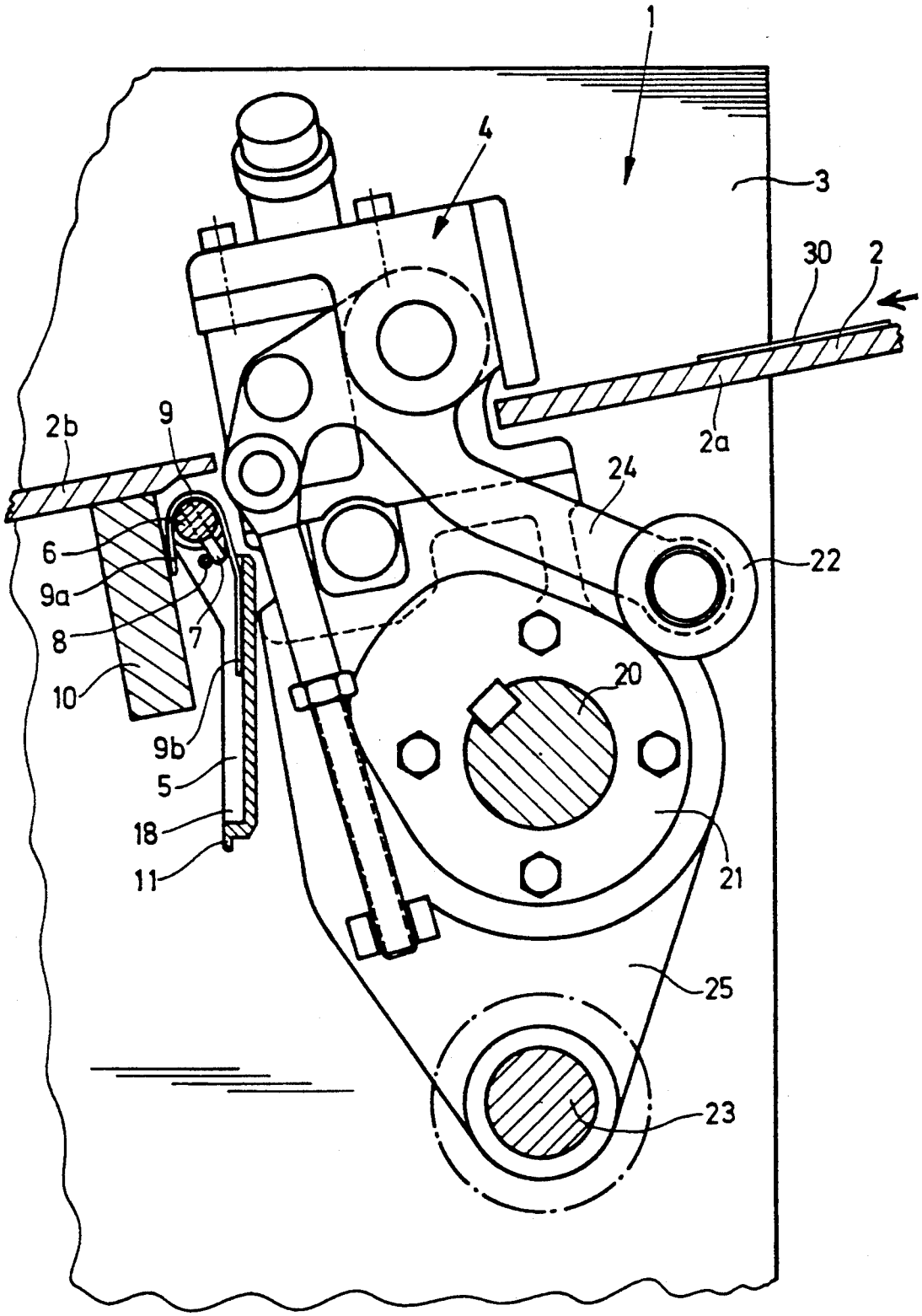
FIG. 1 is a side elevational view of a feed table according to the invention installed, by way of example, in the vicinity of a laterally adjustable side lay.
Figure 2:
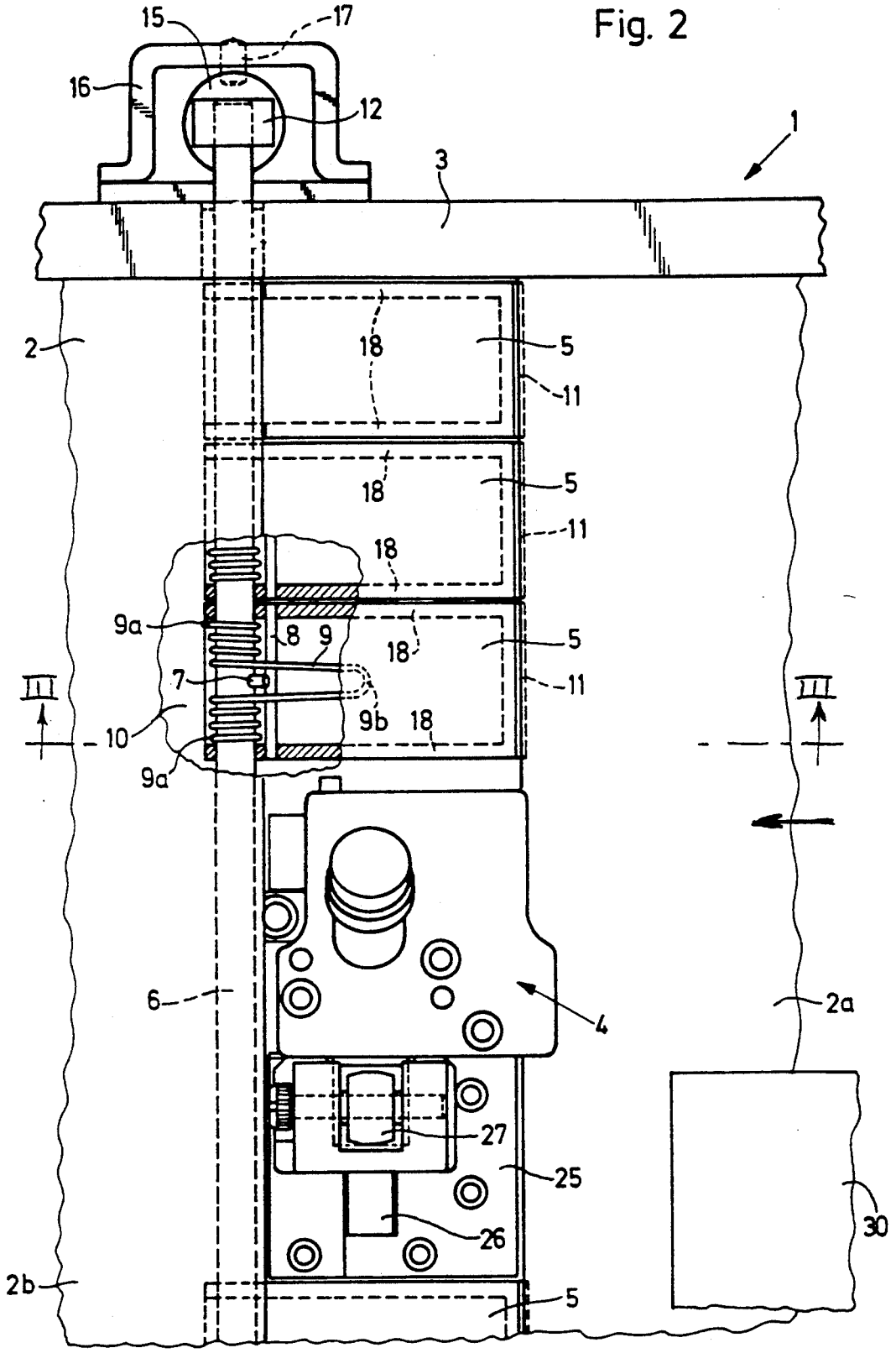
FIG. 2 is a top plan view of FIG. 1.

Referring now to the drawings and, first, particularly to FIGS. 1 and 2, details of a feed table 1 of a sheet-fed offset rotary printing press are shown therein. Between side walls of the press, only the right-hand side wall 3 of which (as viewed in the conveying direction of sheets 30 represented by the arrow at the right-hand side of the figures) is shown, there is mounted a table top 2. The paper sheets 30, only one of which is shown in FIG. 1, are conveyed by conveying means from a feed pile over one side *2a* of the feed table 2 into a region under the influence of a side lay 4 of conventional type. After being aligned by the side lay 4, the paper sheets 30 are conveyed further over a feed-table side *2b* to a first printing unit. The feed pile, conveying means and printing unit, which are of conventional constructions are not shown in the drawings.

In the vicinity of the side lay 4, the table top 2 of the feed table 1 is formed of several juxtaposed table-top elements 5 disposed transversely to the conveying direction of the sheets 30. A retaining lug 18 is provided on the underside of each of the table-top elements 5 at both sides thereof facing towards the side walls 3, and a stop 11 is provided on a side of each of the table-top elements 5 facing towards the table-top side *2a*.

An actuating shaft 6 is disposed below the table top *2b*immediately after the table-top elements 5 in the conveying direction of the sheets 30 and extends transversely to the conveying direction, the actuating shaft 6 being held in the side frames 3. The table-top elements 5 are freely rotatably held by their retaining lugs 18 in an axially fixed manner on the actuating shaft 6.

Each table-top element 5 is provided, between the respective retaining lugs 18 thereof, with a torsion spring 9 wound around the actuating shaft 6. The torsion spring 9 in one region *9b* thereof is braced from below against the appertaining table-top element 5. A counter-bearing formed by a table extension 10 in regions *9a* (note: FIG. 2) of the spring 9 is disposed after the actuating shaft 6 in the conveying direction of the sheets 30 and below the table top *2b*.

Below the spring region *9b*, as viewed in FIG. 3, between the retaining lugs 18 of each table-top element, a stop pin 8 extending parallel to the actuating shaft 6 is positioned in the lugs 18 before the actuating shaft 6 in the conveying direction of the sheets 30 . For each table-top element 5, an entrainer pin 7 is centrally fastened in the actuating shaft 6 and aligned radially with respect to the latter.

Figure 5:
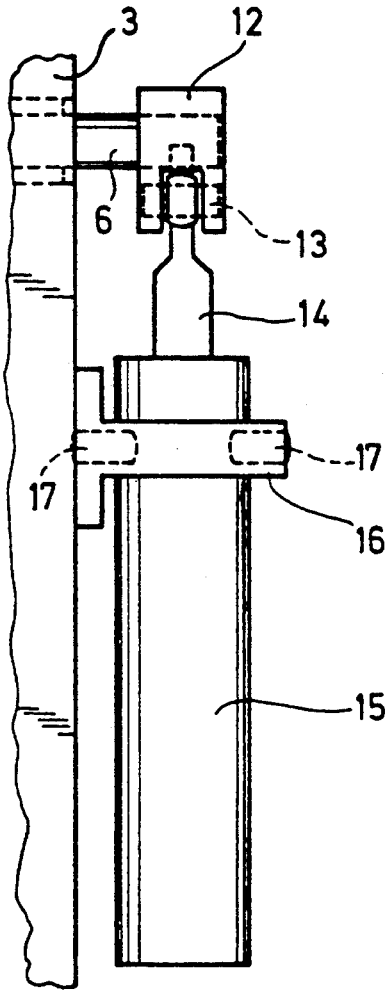
FIG. 5 is a fragmentary side elevational view of FIG. 1 showing a pneumatic cylinder of the invention in greater detail.

As shown in FIG. 5, a fork lever 12 is fastened to the actuating shaft 6 at an extension thereof passing through one of the side walls 3. A piston rod 14 of a pneumatic cylinder 15 is rotatably fastened to a bearing pin 13 which is, in turn, fastened in the fork lever 12. The pneumatic cylinder 15 is swivelably held on the side wall 3 by a bearing pin 17 in a mounting support 16.

Figure 3:
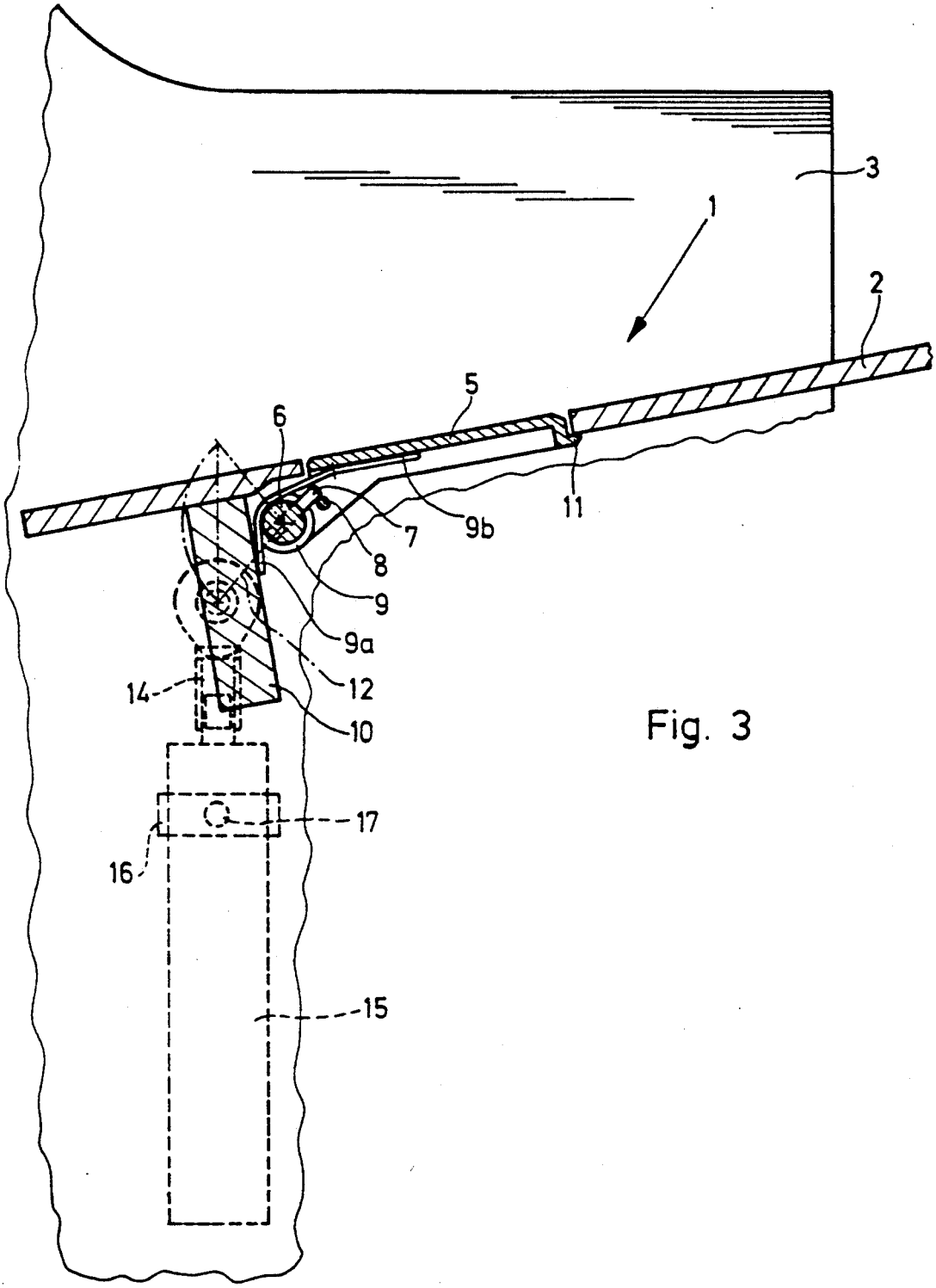
FIG. 3 is a sectional view of FIG. 2 taken along the line III—III and showing a table top element of the invention in position in the table top.

With the piston in the retracted state thereof in the pneumatic cylinder 15, the table-top elements 5, as can be seen in FIG. 3, are forced by the springs 9 towards the position thereof in the table top 2, which is assumed by them the instant the stop 11 on each table-top element 5 comes into contact with the table top 2. Consequently, the spring force of the spring 9 holds the table-top elements 5 in the position thereof also while the sheets are being conveyed.

Figure 4:
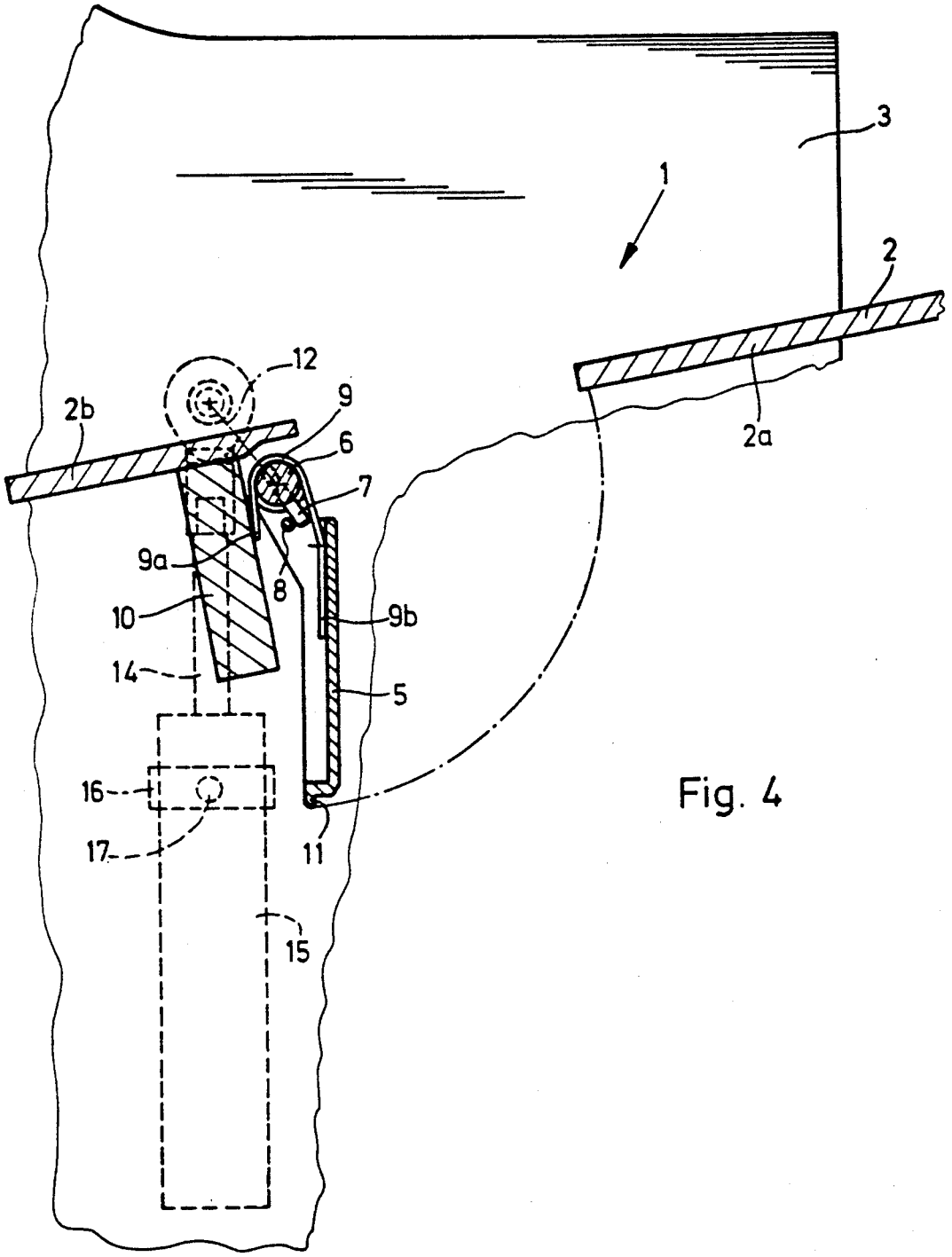
FIG. 4 is a view like that of FIG. 3 in another operating phase of the invention wherein the table-top element is in position below the table top.

When the piston of the pneumatic cylinder 15 is extended, as shown in FIG. 4, the entrainer pin 7 is swiveled with the actuating shaft 6 so that the stop pin 8 and, thus, the table-top element 5 are swiveled thereby downwardly about the axis of the actuating shaft 6 and against the force of the spring 9.

Shown in FIGS. 1 and 2 is a side lay 4 of conventional type having a pull-type rail 26 which entrains the paper sheet 30 from below, and having a contact roller 27 acting cyclically from above on the sheet 30 so as to produce friction contact for the entrainment of the sheet. The side lay 4 is mounted in the gap between the table sides *2a* and *2b* formed when the table-top elements 5 are swiveled away and is displaceable along the gap.

When the table-top elements 5 are swiveled away, the side lay 4 is moved into the desired lateral working position. The pneumatic cylinders 15 are then retracted again, and the driver pins 7 are swiveled upwardly, as viewed in FIG. 1. Due to the spring force of the spring 9, the table-top elements 5 are swiveled towards the plane of the table top 2, from the position thereof shown in FIG. 1, until they come up either against the side lay 4, to the extent that the side lay 4 may be within the swivel range of the table-top elements 5, or against the table top *2a* when engaged by the stop 11 of the respective table-top elements 5. The upwardly swiveled table-top elements 5 thus afford reliable guidance of the sheets in the vicinity of the side lay 4.

The side lay 4 has a body 25 by which it is displaceably mounted on a drive shaft 20 below the feed table 2, the drive shaft 20 being journaled at opposite ends thereof in the side walls 3. The body 20 is formed, moreover, with a thread below the feed table 2 for receiving a spindle 23 therein, which is supported in the side walls 3.

The pull-type rail 26 is mounted in the body 25 of the side lay 4 so as to be laterally displaceable transversely to the conveying direction of the paper sheets as represented by the arrow shown at the right-hand side of FIGS. 1 and 2. The pull-type rail is operatively connected with a non-illustrated axial control cam which is mounted, fixed against relative rotation therewith, on the drive shaft 20 and is displaceable together with the body 25. The contact roller 27 has a non-illustrated driving connection with a lever 24. The lever 24 carries a cam-sensing or follower roller 22, which is in operative engagement with a radial cam 21. The radial cam 21 is held on the control shaft 20, fixed against relative rotation therewith, and is axially displaceable together with the body 25.

Thus, through the intermediary of the non-illustrated conventional axial control cam, the pull-type lay 4 is moved cyclically by the driven drive shaft 20 so as to bring the paper sheet 30 up against a non-illustrated lateral stop provided in the side lay 4, the contact roller 27 being raised and lowered cyclically through the intermediary of the radial cam 21.

The foregoing is a description corresponding in substance to German Application P 41 22 770.0, dated Jul. 10, 1991, the International priority of which is being claimed for the instant application, and which is hereby made part of this application. Any material discrepancies between the foregoing specification and the aforementioned corresponding German application are to be resolved in favor of the latter.

I claim:

1. Method of forming and varying at least one of size and location of a pass-through opening extending transversely to a sheet-feeding direction in a table top of a feed table of a sheet-fed printing press, which comprises providing a plurality of adjustable table-top elements disposed transversely to the sheet-feeding direction at the pass-through opening. and varying the position of the table-top elements with respect to the table top of the feed table.

2. Method according to claim 1, which includes moving the table-top elements from a first position thereof wherein they are in a common plane with the table top to a second position thereof wherein they extend below the table top.

3. Method according to claim 2, which includes simultaneously moving a plurality of the table-top elements out of the first position thereof into the second position thereof; returning at least one of the table-top elements to the first position thereof while retaining at least one of the table-top elements in the second position thereof.

4. Feed table of a sheet-fed printing press, comprising a table top formed with a pass-through opening therein extending transversely to a travel direction in which sheets are fed along the table, a plurality of juxtaposed adjustable table-top elements respectively disposed at said pass-through opening and, in a first position thereof, closing said pass-through opening, and actuating means for moving said table-top elements out of said first position thereof and into a second position thereof wherein said pass-through opening is open.

5. Feed table according to claim 4, wherein said table-top elements, in said first position thereof, are in a common plane with said table top and, in said second position thereof, are disposed below said table top.

6. Feed table according to claim 4, wherein said actuating means comprises an actuating member common to said plurality of table-top elements, and including respective energy-storage mechanisms for resiliently connecting each of said table-top elements to said actuating member.

7. Feed table according to claim 6, wherein said actuating member is a driven actuating shaft.

8. Feed table according to claim 4, wherein said second position of said table-top elements below said table top is a swivel position with respect to said first position thereof.

9. Feed table of a sheet-fed printing press, comprising a table top formed with a pass-through opening therein extending transversely to a travel direction in which sheets are fed along the table, a plurality of juxtaposed adjustable table-top elements, in a first position thereof, closing said pass-through opening and actuating means for moving said table-top elements out of said first position thereof and into a second position thereof wherein said pass-through opening is open, said actuating means comprising an actuating member common to said plurality of table-top elements, and respective energy-storage mechanisms for resiliently connecting each of said table-top elements to said actuating member, said actuating member being a driven actuating shaft, said actuating shaft being disposed below said table top and extending transversely to said travel direction of the sheets, each of said table-top elements being fastened at a respective edge portion thereof axially to said actuating shaft, said energy-storage mechanisms comprising respective torsion springs braced against.

* * * * *